US011145950B2

(12) United States Patent
Aizawa

(10) Patent No.: US 11,145,950 B2
(45) Date of Patent: Oct. 12, 2021

(54) ELECTRONIC TIMEPIECE

(71) Applicant: Seiko Epson Corporation, Tokyo (JP)

(72) Inventor: Tadashi Aizawa, Matsumoto (JP)

(73) Assignee: Seiko Epson Corporation

( * ) Notice: Subject to any disclaimer, the term of this patent is extended or adjusted under 35 U.S.C. 154(b) by 7 days.

(21) Appl. No.: 16/537,669

(22) Filed: Aug. 12, 2019

(65) Prior Publication Data

US 2020/0052370 A1 Feb. 13, 2020

(30) Foreign Application Priority Data

Aug. 13, 2018 (JP) ..... JP2018-152321

(51) Int. Cl.

| | |
|---|---|
| ***H01Q 1/22*** | (2006.01) |
| ***H01Q 1/42*** | (2006.01) |
| ***G04G 17/06*** | (2006.01) |
| ***G04G 17/04*** | (2006.01) |
| ***G04G 21/04*** | (2013.01) |

(52) U.S. Cl.

CPC ..... *H01Q 1/22* (2013.01); *G04G 17/04* (2013.01); *G04G 17/06* (2013.01); *G04G 21/04* (2013.01); *H01Q 1/42* (2013.01)

(58) Field of Classification Search

CPC ..... H01Q 1/22; H01Q 1/42; H01Q 1/241; H01Q 1/243; H01Q 1/273; H01Q 1/521; H01Q 1/525; H01Q 5/378; H01Q 9/0421; H01Q 9/42

See application file for complete search history.

(56) References Cited

U.S. PATENT DOCUMENTS

| | | | | |
|---|---|---|---|---|
| 10,122,073 | B2 * | 11/2018 | Sano | H01Q 1/273 |
| 10,599,102 | B2 * | 3/2020 | Sawada | G04R 60/10 |
| 2009/0284433 | A1 * | 11/2009 | Tsutsumi | H01Q 21/30 343/825 |
| 2011/0156982 | A1 * | 6/2011 | Asada | F16B 33/004 343/872 |
| 2014/0104157 | A1 * | 4/2014 | Burns | H01Q 1/44 345/156 |
| 2014/0232612 | A1 * | 8/2014 | Jenwatanavet | H01Q 9/0421 343/893 |
| 2014/0323063 | A1 * | 10/2014 | Xu | H01Q 9/0442 455/77 |

(Continued)

FOREIGN PATENT DOCUMENTS

| | | |
|---|---|---|
| JP | 2017-118377 A | 6/2017 |
| JP | 2018-136296 A | 8/2018 |
| JP | 2019-158445 A | 9/2019 |

*Primary Examiner* — Tung X Le

(74) *Attorney, Agent, or Firm* — Harness, Dickey & Pierce, P.L.C.

(57) ABSTRACT

Provided is technology improving antenna sensitivity. An electronic timepiece has: an antenna having a planar first electrode, a planar second electrode disposed to a position superimposed with the first electrode in plan view when seen from a first direction perpendicular to the first electrode, and a shorting member that shorts the first electrode and second electrode; and a planar conductor disposed in plan view to a position superimposed with the first electrode. The second electrode is disposed between the first electrode and the conductor in a side view from a second direction perpendicular to the first direction, and a connector electrically connects the second electrode and conductor.

12 Claims, 9 Drawing Sheets

(56) References Cited

U.S. PATENT DOCUMENTS

| | | | | |
|---|---|---|---|---|
| 2017/0184724 | A1 | 6/2017 | Aizawa | |
| 2018/0239308 | A1 | 8/2018 | Yamamoto et al. | |
| 2019/0196414 | A1* | 6/2019 | Eshima | G04G 17/04 |

* cited by examiner

ELECTRONIC TIMEPIECE

This application is based upon Japanese Patent Application 2018-152321 filed on Aug. 13, 2018, the entire contents of which are incorporated by reference herein.

BACKGROUND

1. Technical Field

The present invention relates to an electronic timepiece.

2. Related Art

Electronic devices with a GPS (Global Positioning System) receiving capability are known from the literature. JP-A-2017-118377, for example, describes an electronic device having an antenna including a planar first electrode, a planar second electrode, and shorting member that shorts the first electrode and second electrode.

However, the electronic device disclosed in JP-A-2017-118377 also produces an electric field on the opposite side of the first electrode as the second electrode. The electric field produced on the opposite side of the first electrode causes a drop in antenna sensitivity.

SUMMARY

An electronic device according to an aspect of the invention has: an antenna having a planar first electrode, a planar second electrode disposed to a position superimposed with the first electrode in plan view when seen from a first direction perpendicular to the first electrode, and a shorting member that shorts the first electrode and second electrode; a planar conductor disposed in plan view to a position superimposed with the first electrode; and a connector that electrically connects the second electrode and conductor. The second electrode is disposed in a side view between the first electrode and the conductor.

An electronic device according to another aspect of the invention has: an antenna having a planar first electrode, a second electrode disposed to a position superimposed with the first electrode in plan view when seen from a direction perpendicular to the first electrode, and a shorting member that shorts the first electrode and second electrode; a conductor including a planar first conductive member disposed in plan view to a position superimposed with the first electrode, a planar second conductive member disposed in the plan view to a position superimposed with the first electrode, and a connector that electrically connects the first conductive member and second conductive member. The second electrode is disposed between the first electrode and the conductor in a side view.

Other objects and attainments together with a fuller understanding of the invention will become apparent and appreciated by referring to the following description and claims taken in conjunction with the accompanying drawings.

DESCRIPTION OF EMBODIMENTS

Preferred embodiments of the invention are described below with reference to the accompanying figures. Note that the scale and size of members and parts shown in the figures referenced below may differ from the actual scale and size for convenience of description and illustration. The following embodiments include various technically desirable limitations while describing preferred embodiments of the invention, but the scope of the invention is not limited to the following unless such limitation is expressly stated.

Embodiment 1

Figure 1:
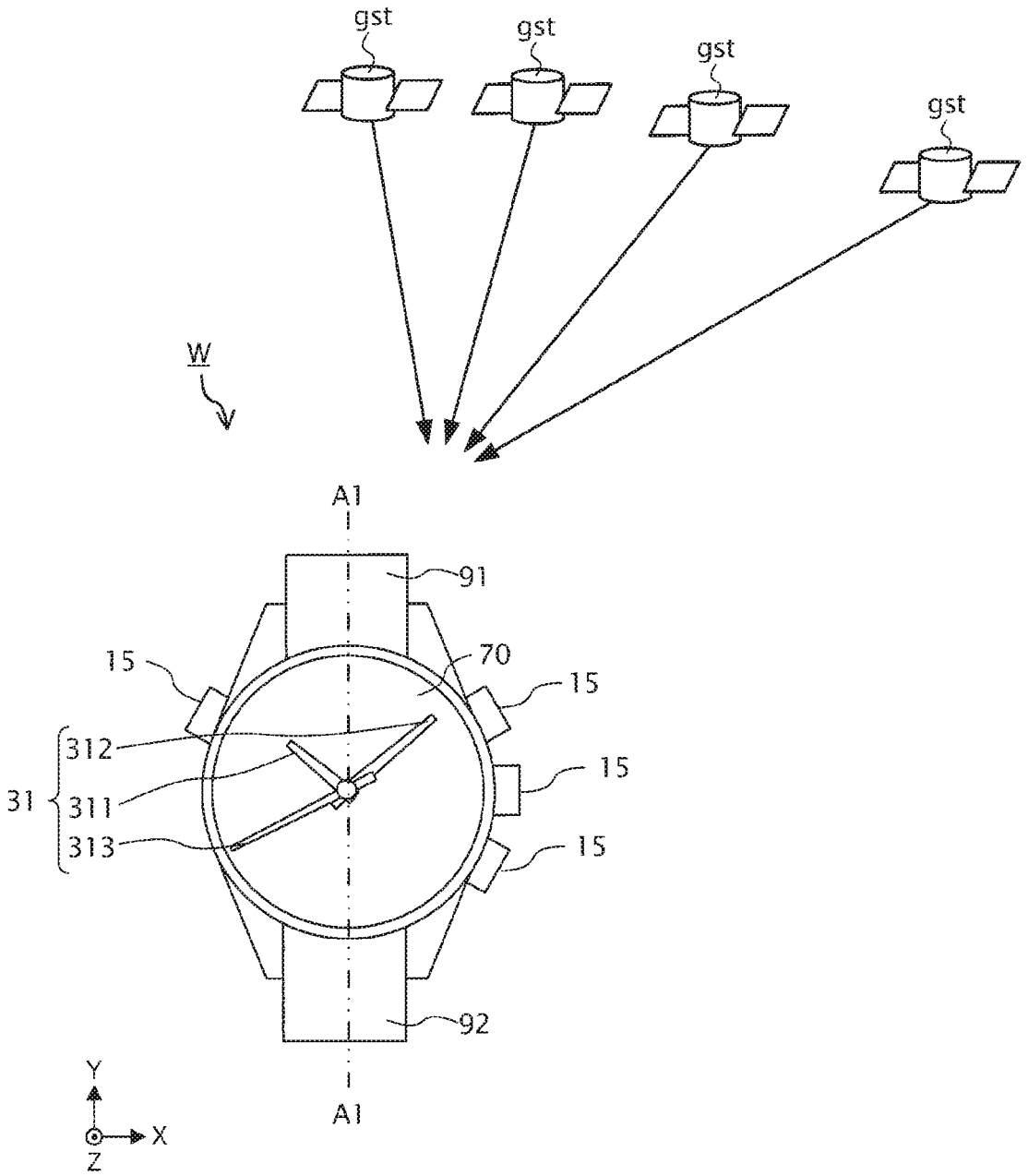
FIG. 1 schematically illustrates the configuration of the Global Positioning System including an electronic timepiece receiver.

FIG. 1 schematically illustrates the configuration of the Global Positioning System including an electronic timepiece as a receiver. As shown in FIG. 1, an electronic device according to the first embodiment of the invention is a wristwatch type electronic timepiece W that is typically worn on the wrist or arm of the user. This electronic timepiece W receives GPS satellite signals transmitted from multiple GPS satellites gst in space, and includes a GPS function enabling calculating the current location. The carrier frequency of GPS satellite signals is 1.57542 GHz. GPS satellite signals are right-hand circularly polarized waves. The electronic timepiece W use the location information and time information calculated from the received GPS satellite signals to measure, for example, the distance, speed, and route that the user runs, and support user exercise and activity.

As shown in FIG. 1, the electronic timepiece W has multiple operating buttons 15, hands 31, a dial 70, a first band 91, and a second band 92. User instructions to the electronic timepiece W can be received by the user pushing the multiple operating buttons 15.

The first band 91 and second band 92 are formed to a length enabling wrapping around the wrist or arm of the user.

The hands 31 are used to indicate time, and the hands 31 include an hour hand 311, a minute hand 312, and a second hand 313.

Numbers are formed on the dial 70. The hour hand 311, minute hand 312, and second hand 313 respectively indicate the hour, minute, and second of the current time by pointing to the appropriate numbers on the dial 70.

The side of the dial 70 in the electronic timepiece W that the user sees to read the time on the dial 70 is referred to herein as the face of the dial 70, and the side of the dial 70 facing the user's wrist or arm is referred to as the back of the dial 70.

In FIG. 1, the direction from the back to the front through the dial 70 is referred to as the positive Z-axis direction. The two axes perpendicular to the Z-axis are the X-axis and Y-axis. The Y-axis goes through the center of the dial 70 to the first band 91 and second band 92, and the axis perpendicular to the Z-axis and the Y-axis is the X-axis. The direction from the second band 92 to the first band 91, that is, the positive Y-axis direction, is defined as the 12:00 direction. The negative Y-axis direction is the 6:00 direction, and the positive X-axis direction is the 3:00 direction.

For brevity below, the positive Z-axis direction side is referred to as the face, and the negative Z-axis direction is referred to as the back. In the figures, "+" indicates the positive direction, and "−" indicates the negative direction. For example, the positive Z-axis direction is indicated as +Z, and the negative Z-axis direction is indicated as −Z.

Figure 2:
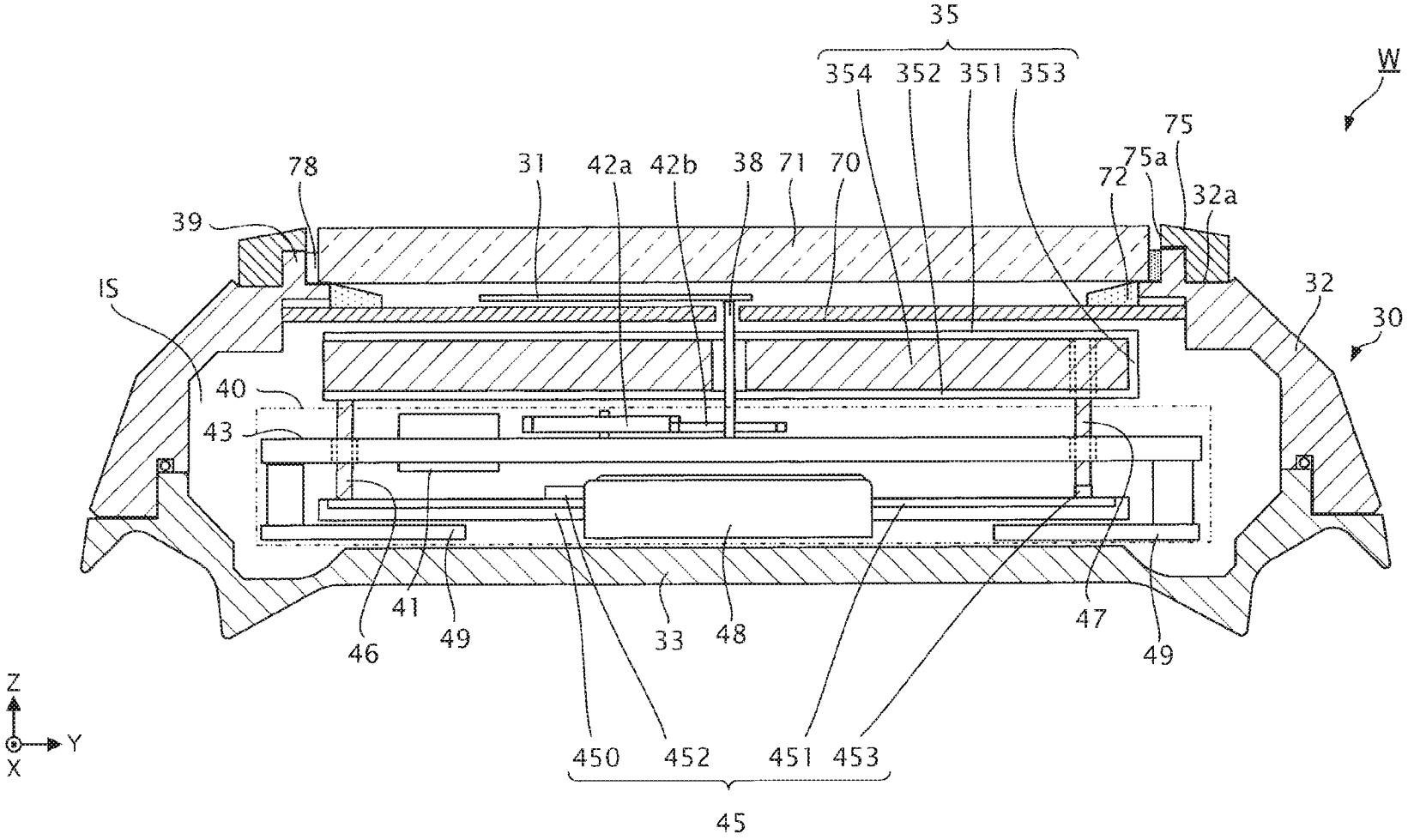
FIG. 2 is a section view of the electronic timepiece W through line A1-A1 in FIG. 1.

FIG. 2 is a section view of the electronic timepiece W through line A1-A1 in FIG. 1. The section view shown in FIG. 2 shows the electronic timepiece W from the positive X-axis direction. As shown in FIG. 2, the electronic timepiece W has a metal case 30, a bezel 75, a bonding member 78, a crystal 71, a dial cover 72, hands 31, a dial 70, an antenna 35, a pivot 38, and a movement 40. To avoid complicating the drawing in FIG. 2, the hour hand 311, minute hand 312, and second hand 313 are represented by hand 31.

The metal case 30 includes a top case 32 and a bottom case 33. The top case 32 is disposed on the face side, and the bottom case 33 is located on the back side. The bottom case 33 and top case 32 are formed from stainless steel or other metal. The dial cover 72, hands 31, dial 70, antenna 35, pivot 38, and movement 40 are disposed inside the metal case 30.

The top case 32 has, around the outside edge of the top case 32, a groove 32*a* that opens to the face side. The groove 32*a* is formed as a ring around the outside of the top case 32. A wall 39 that protrudes to the face side is formed along the inside circumference of the groove 32*a*. Part of the bezel 75 is inserted and fixed in the groove 32*a*.

The bezel 75 has a flange 75*a* that projects to the crystal 71 side. The bezel 75 may be made from stainless steel, brass, or other metal with plating on the surface.

The crystal 71 protecting the inside of the electronic timepiece W is disposed inside the bezel 75. The crystal 71 is connected to the inside circumference surface of the wall 39 through the bonding member 78.

The dial 70 is located on the negative Z-axis side of the crystal 71. The dial cover 72 is disposed between the dial 70 and the crystal 71. The hands 31 are also disposed between the dial 70 and the crystal 71. An internal space IS is formed in the electronic timepiece W by the dial 70, top case 32, and bottom case 33.

The antenna 35, pivot 38, and movement 40 are included inside the internal space IS.

The antenna 35 includes a planar first electrode 351, a planar second electrode 352 disposed to a position superimposed with the first electrode 351 when seen in plan view from the positive Z-axis direction, which is the direction perpendicular to the first electrode 351, a shorting member 353 that shorts the first electrode 351 and second electrode 352, and a spacer 354.

The first electrode 351 and second electrode 352 are disposed substantially parallel to the XY plane with a space therebetween. The antenna 35 is a planar inverted-F antenna.

The spacer 354 is disposed between the first electrode 351 and second electrode 352. The spacer 354 is a planar member of a substantially constant thickness. The spacer 354 is an insulator such as a plastic with a low dissipation factor. The spacer 354 is a dielectric, and reduces the size of the antenna by the wavelength shortening effect of the dielectric.

The first electrode 351, second electrode 352, and shorting member 353 are conductive thin films formed on the spacer 354 by plating or vapor deposition. The first electrode 351 is formed on the positive Z-axis side surface of the spacer 354. The second electrode 352 is formed on the negative Z-axis side surface of the spacer 354. The shorting member 353 is formed on the side of the spacer 354. The metal used for the first electrode 351, second electrode 352, and shorting member 353 is copper in this example. The plane shape of the antenna 35 is substantially round in a plan view through the thickness of the antenna 35 as shown in FIG. 3 and FIG. 4 described below.

References to a plan view below mean a plan view from the direction perpendicular to the first electrode 351, that is, from the positive Z-axis direction. The view when looking at the electronic timepiece W from the direction perpendicular to the Z-axis is referred to as a side view. The directions perpendicular to the Z-axis are, for example, the positive X-axis direction, negative X-axis direction, positive Y-axis direction, and negative Y-axis direction. FIG. 2 is therefore a figure looking at the electronic timepiece W in a side view.

Figure 3:
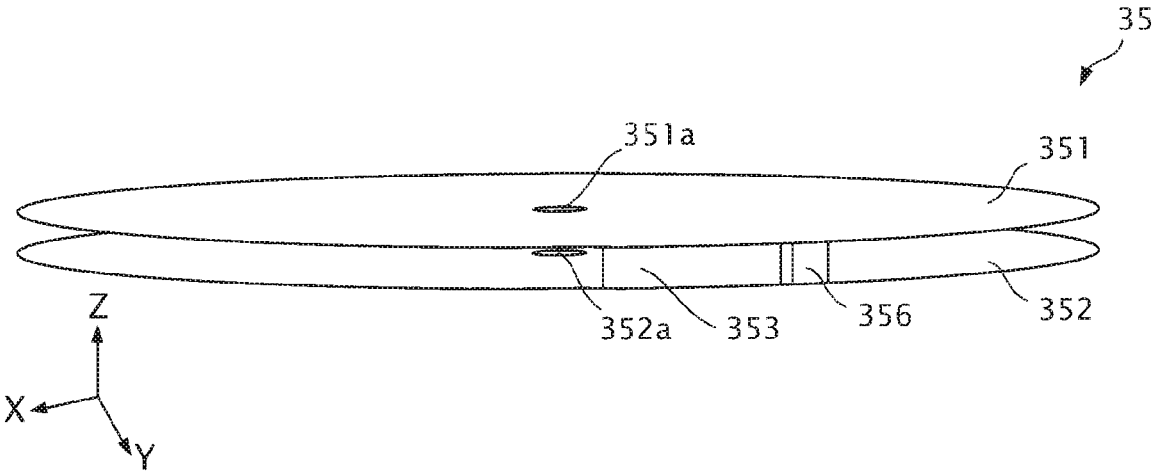
FIG. 3 is a first perspective view of the antenna 35.
Figure 4:
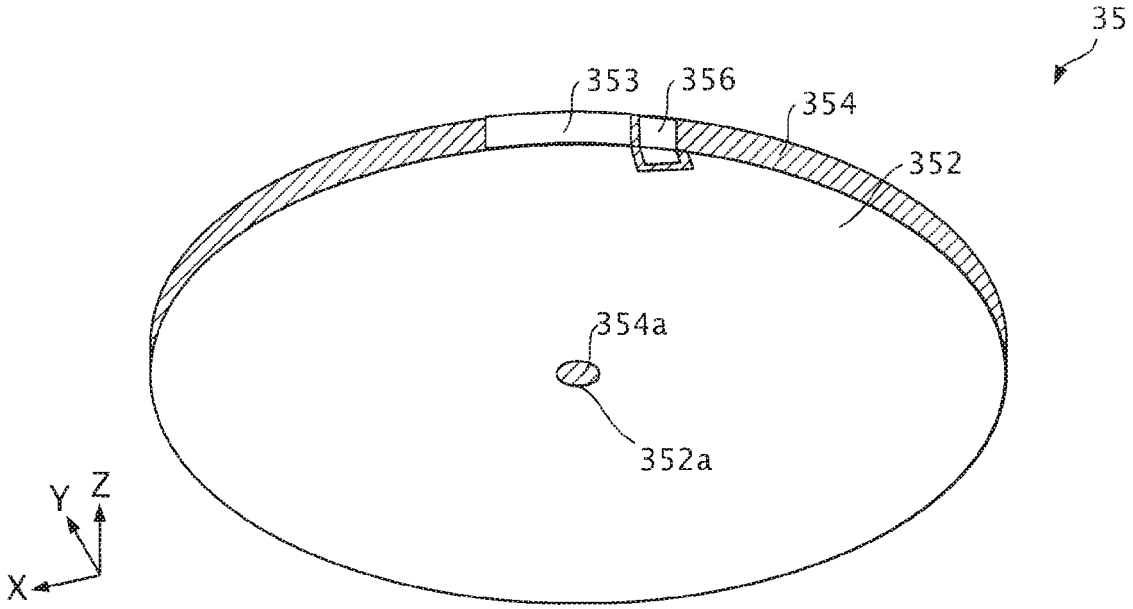
FIG. 4 is a second perspective view of the antenna 35.

FIG. 3 and FIG. 4 are perspective views of the antenna 35. FIG. 3 is a perspective view of the antenna 35 without the spacer 354, and FIG. 4 is a perspective view of the antenna 35 with the spacer 354. As shown in FIG. 3 and FIG. 4, the antenna 35 has a feed 356 in addition to the first electrode 351, second electrode 352, shorting member 353, and spacer 354. The feed 356 is formed from the side of the spacer 354 to the back, and is separated from the second electrode 352. Formed in the first electrode 351, second electrode 352, and spacer 354 are, respectively, through-hole 351*a*, through-hole 352*a* and through-hole 354*a* through which the pivot 38 passes. The shorting member 353 is disposed to the 12:00 position.

Referring again to FIG. 2, the pivot 38 turns the hands 31 when the pivot 38 turns.

The movement 40 includes a stepper motor 41, wheel 42*a*, wheel 42*b*, main plate 43, circuit board 45, connector 46, signal line 47, battery 48, and circuit board holder 49.

The stepper motor 41 is a drive element that drives the hands 31. Wheel 42*a* and wheel 42*b* transfer rotation of the stepper motor 41 to the pivot 38. Rotation of the stepper motor 41, which is the driver, in the electronic timepiece W is speed reduced and transferred through wheel 42*a* and wheel 42*b* to the pivot 38, and when the pivot 38 turns, the hands 31 move rotationally. The stepper motor 41, wheel 42*a*, wheel 42*b*, and pivot 38 are disposed to the main plate 43.

The main plate 43 is a planar member that serves as the foundation on which the movement 40 is assembled. The main plate 43 is made from plastic or other non-conductive material.

The circuit board 45 is a member disposed to a position superimposed with the first electrode 351 in plan view. The second electrode 352 is disposed between the first electrode 351 and circuit board 45 in side view.

The circuit board 45 includes a planar substrate 450, conductive layer 451, circuit element 452, and reception circuit 453. The circuit element 452 and reception circuit 453 are disposed on the face side of the substrate 450. The conductive layer 451 is a layer of a conductive thin film formed on the surface or inside the substrate 450. The circuit board 45 is disposed substantially parallel to the XY plane, and the conductive layer 451 is also disposed substantially parallel to the XY plane. Therefore, like the circuit board 45, the conductive layer 451 is disposed to a position superimposed with the first electrode 351 in plan view. The second electrode 352 may also be said to be located in side view between the first electrode 351 and conductive layer 451.

The conductive layer 451 is an example of a conductor. In plan view, the plane shape of the conductive layer 451 is round. Also in plan view, the second electrode 352 and conductive layer 451 are superimposed with each other, and the superimposed area is preferably as large as possible.

The circuit elements 452 include, for example, a DSP (Digital Signal Processor), CPU (Central Processing Unit), SRAM (Static Random Access Memory), an RTC (Real Time Clock) with an internal temperature compensated crystal oscillator (TCXO), and flash memory. The circuit board 45 is attached to the main plate 43 by a circuit board holder 49.

The connector 46 electrically connects the conductive layer 451 and second electrode 352. The connector 46 in this example is a conductive pin. For example, the connector 46 may be a round or square column aligned with the Z-axis. One end of the connector 46 connects to the second electrode 352, and the other end connects to the conductive layer 451. There are multiple connectors 46 disposed on the XY plane. In the first embodiment of the invention there are three connectors 46. The three connectors 46 are disposed in this example at 3:00, 6:00, and 9:00 positions.

The signal line 47 supplies GPS satellite signals received through the first electrode 351 and second electrode 352 to the reception circuit 453. The reception circuit 453 processes the GPS satellite signals, and supplies the processed signals to the circuit elements 452.

Both terminals of the battery 48 are connected to the circuit board 45, and the battery 48 supplies power to a circuit that controls the power supply. The power is converted by this circuit to a specific voltage, and supplied to the circuit elements 452 and reception circuit 453. The battery 48 may be a primary cell or a rechargeable storage battery.

Figure 5:
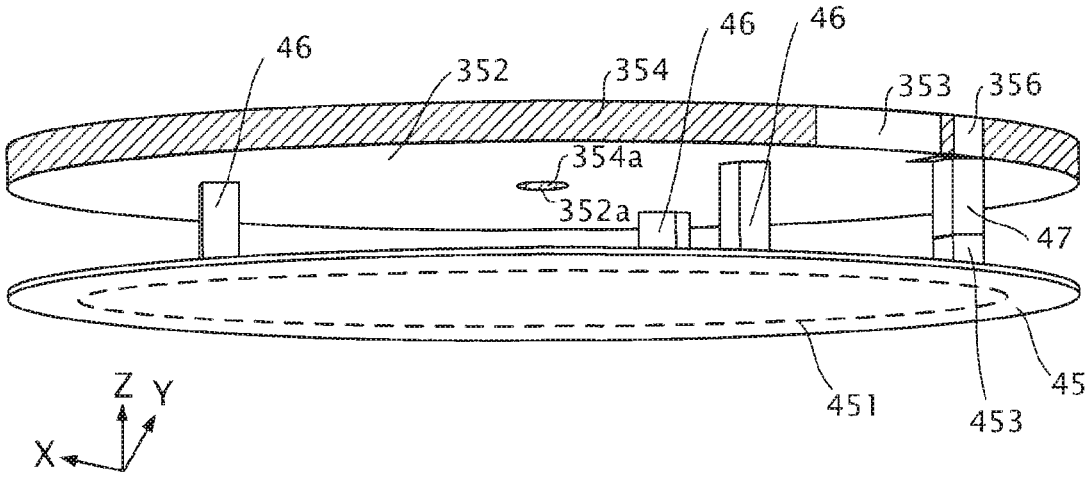
FIG. 5 is a perspective view of the antenna 35 and circuit board 45.

FIG. 5 is a perspective view of the antenna 35 and circuit board 45. As shown in FIG. 5, the second electrode 352 of the antenna 35 and the conductive layer 451 of the circuit board are electrically connected by the multiple connectors 46 disposed on the XY plane. In the example in FIG. 5, there are three connectors 46. The reception circuit 453 also connects to the first electrode 351 through the signal line 47 and feed 356.

Effect of Embodiment 1

As described above, an electronic timepiece W as an example of an electronic device according to the invention has an antenna 35 including a planar first electrode 351, a planar second electrode 352 disposed to a position superimposed with the first electrode 351 when seen in plan view in a direction perpendicular to the first electrode 351, and a shorting member 353 that shorts the first electrode 351 and second electrode 352; and a planar conductive layer 451 disposed to a position superimposed with the first electrode 351 in plan view. The second electrode 352 has a connector 46 that is disposed in a side view between the first electrode 351 and the conductive layer 451, and electrically connects the second electrode 352 and conductive layer 451.

This configuration can improve the sensitivity of the antenna 35 compared with an antenna 35 that is not connected to the conductive layer 451 by a connector 46. There are two reasons why the sensitivity of the antenna 35 improves as described below.

A first reason antenna 35 sensitivity improves is because the antenna 35 of the first embodiment achieves the same effect as when the antenna is thicker. This is because as the average thickness of the antenna thickness increases in a planar inverted-F antenna, the sensitivity of the antenna increases. The reason sensitivity improves as antenna thickness increases is because the amount of current that is mutually cancelled in the first electrode and second electrode decreases. Current flows through the first electrode in the opposite direction as the current flow in the second electrode, and as the antenna becomes thinner, the amount of current that is mutually cancelled in the first electrode and second electrode increases.

Figure 6:
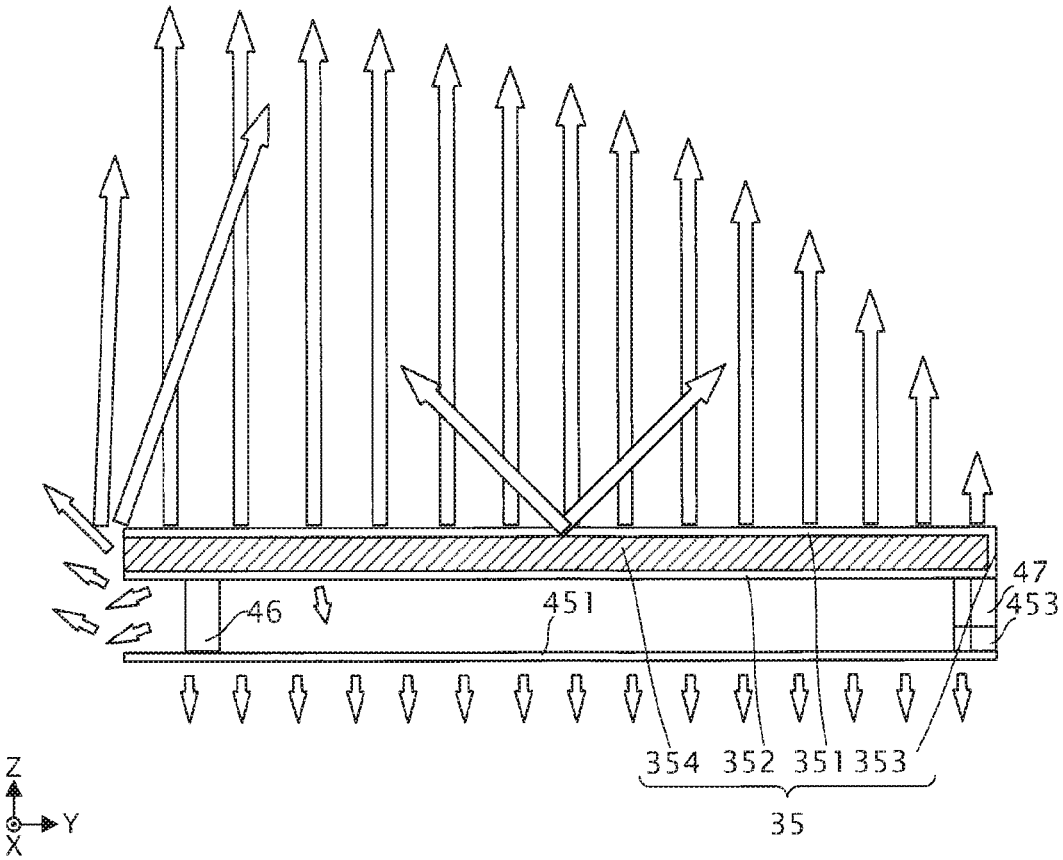
FIG. 6 illustrates the electric field distribution around the antenna 35.

FIG. 6 illustrates the electric field distribution around the antenna 35. The arrows in FIG. 6 indicate the direction and size of the electric field. As shown in FIG. 6, substantially no electric field is produced between the second electrode 352 and circuit element 452, the electric field increases as the distance between the first electrode 351 and second electrode 352 increase, and radiation efficiency improves. Radiation efficiency is the ratio of the power radiated as radio waves into space to the input power to the antenna. The greater the radiation efficiency, the higher the antenna sensitivity.

Figure 7:
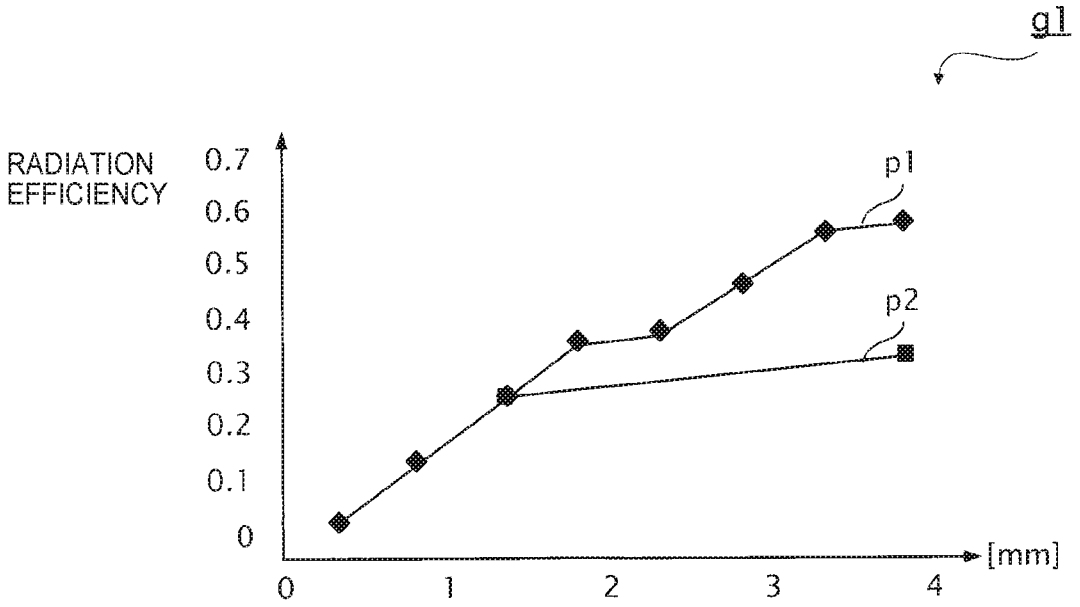
FIG. 7 shows the relationship between antenna thickness and radiation efficiency.

FIG. 7 shows the relationship between the thickness of the antenna 35 and radiation efficiency. Curve p1 in the graph g1 in FIG. 7 represents radiation efficiency relative to the thickness of the antenna 35. As indicated by the curve p1, radiation efficiency improves as the thickness of the antenna 35 increases.

Curve p2 in graph g1 represents radiation efficiency relative to the distance between the second electrode 352 of the antenna 35 according to this embodiment and the conductive layer 451. As indicated by curve p2, the improvement in radiation efficiency is not as great as when the thickness of the antenna increases, but radiation efficiency improves as the distance between the second electrode 352 and conductive layer 451 increases.

A second reason antenna 35 sensitivity improves is because a parasitic planar inverted-F antenna is formed by the second electrode 352 and conductive layer 451, and the radiation of the parasitic planar inverted-F antenna combines with the radiation of the antenna 35 and radiation efficiency improves.

A parasitic planar inverted-F antenna is referred to below as simply a parasitic antenna. Forming a parasitic antenna becomes easier when the number of connectors 46 is small, or when multiple connectors 46 are concentrated in a particular area. Radiation efficiency is approximately 10% even when the bandwidth of the parasitic antenna is wide and the frequency is approximately 500 MHz apart from the resonance frequency of the parasitic antenna. The sensitivity of the antenna 35 improves even if the resonance frequency of the parasitic antenna and the resonance frequency of the antenna 35 are not the same. The resonance frequency of the parasitic antenna changes according to the number and locations of the connectors 46.

An electronic timepiece W as an example of an electronic device according to the invention has multiple connectors 46. By disposing the multiple connectors 46 dispersed on the XY plane in the configuration described above, substantially no electric field is produced between the second electrode 352 and conductive layer 451, the sensitivity of the antenna 35 improves for the first reason that the sensitivity of the antenna 35 improves. However, even if the multiple connectors 46 are concentrated in a particular area on the XY plane, the sensitivity of the antenna 35 improves for the second reason the antenna 35 sensitivity improves as the resonance frequency of the parasitic antenna approaches the resonance frequency of the antenna 35.

An electronic timepiece W as an example of an electronic device according to the invention also has a metal case 30 to which the antenna 35 is disposed. Compared with a configuration in which the antenna 35 and the conductive layer 451 are disposed in a plastic (resin) case, the configuration described above can improve the increase in the radiation efficiency of the antenna 35 by the connector 46 connecting the antenna 35 and conductive layer 451.

The simulated results of radiation efficiency of the antenna 35 and antenna sensitivity at a frequency of 1.42 GHz in reference 1-1, example 1-1, reference 1-2, and the first embodiment of the invention are described below.

Reference 1-1: The antenna 35 and conductive layer 451 are housed in a plastic case, and the antenna 35 and conductive layer 451 are not connected by connectors 46.

Comparison 1-1: The antenna 35 and conductive layer 451 are housed in a plastic case, and the antenna 35 and conductive layer 451 are connected by three connectors 46.

Reference 1-2: The antenna 35 and conductive layer 451 are housed in a metal case 30, and the antenna 35 and conductive layer 451 are not connected by connectors 46.

First Embodiment

The antenna 35 and conductive layer 451 are housed in a metal case 30, and the antenna 35 and conductive layer 451 are connected by three connectors 46.

The radiation efficiency of reference 1-1 is 0.2280, and antenna sensitivity is −6.42 dB.

The radiation efficiency of comparison 1-1 is 0.2983, and the antenna sensitivity is −5.25 dB.

Radiation efficiency therefore increases 0.0703, and antenna sensitivity increases 1.17 dB, by connecting the antenna 35 and conductive layer 451 by connectors 46.

The radiation efficiency of reference 1-2 is 0.1331, and antenna sensitivity is −8.75 dB.

The radiation efficiency of the first embodiment is 0.2382, and antenna sensitivity is −6.23 dB.

Radiation efficiency therefore increases 0.1051, and antenna sensitivity increases 2.52 dB, by connecting the antenna 35 and conductive layer 451 by connectors 46.

As described above, the improvement in the radiation efficiency of the antenna 35 between the first embodiment and reference 1-2 that is achieved by connecting the antenna 35 and conductive layer 451 through connectors 46 is thus greater than the improvement between the comparison 1-1 and reference 1-1. The reason the increase in radiation efficiency of the antenna 35 is improved by a metal case 30 is described below using reference 1-3 from which the circuit board 45 of the first embodiment is omitted.

Figure 8:
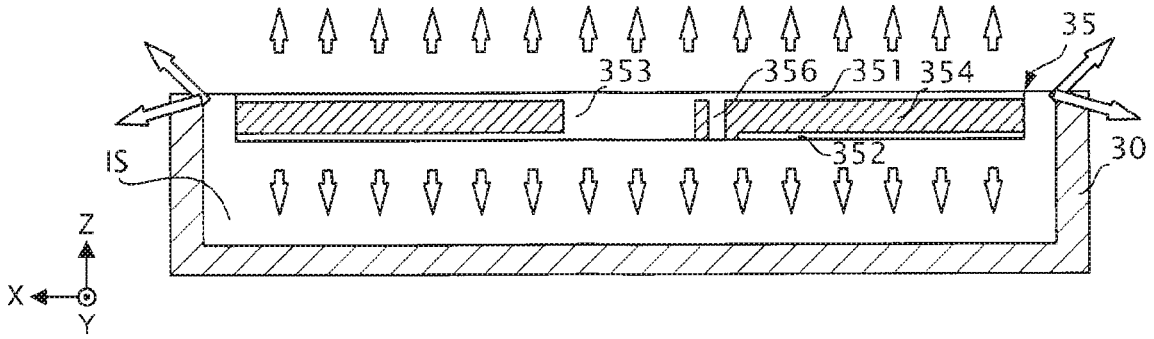
FIG. 8 illustrates electric field production in reference examples 1 to 5.

FIG. 8 illustrates creation of an electric field in reference 1-3. The arrows in FIG. 8 indicate the direction and size of the electric field. In reference 1-3 an electric field is radiated in the positive Z-axis direction and the negative Z-axis direction. The electric field radiated in the negative Z-axis direction is randomly reflected in the internal space IS between the antenna 35 and the metal case 30, and converted to heat. Conversion of the electric field to heat causes a drop in radiation efficiency.

Figure 9:
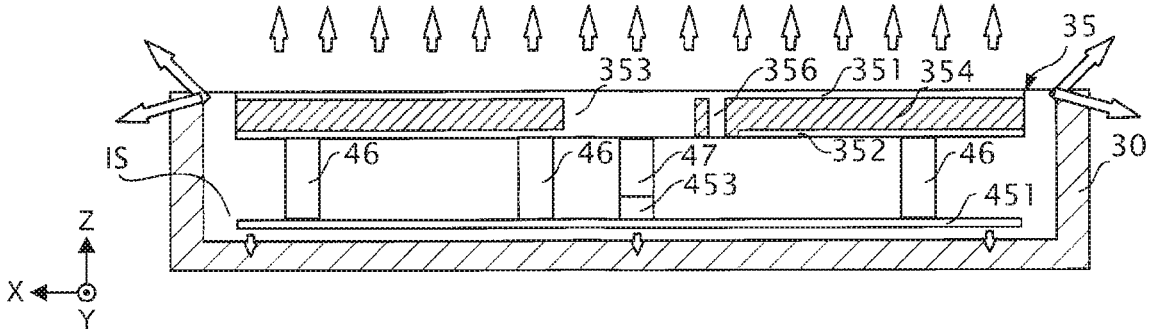
FIG. 9 illustrates electric field production in a first embodiment of the invention.

FIG. 9 illustrates creation of an electric field in the first embodiment. The arrows in FIG. 9 indicate the direction and size of the electric field. Because the second electrode 352 and conductive layer 451 are connected by the connectors 46 in the first embodiment, the second electrode 352 and conductive layer 451 have the same potential and substantially no electric field is produced. Where some degree of an electric field is produced in the area in the negative Z-axis direction from the antenna 35 is only between the conductive layer 451 and metal case 30. As a result, As a result, the same condition is created as when the space between the second electrode 352 and conductive layer 451 is filled with metal, and radiation efficiency improves.

Embodiment 2

The ratio between the radiation of right-hand circularly polarized waves and left-hand circularly polarized waves can be changed by the locations of the connectors 46. A second embodiment of the invention is described below. Elements of the following embodiments and variations that have the same operation or function as in the first embodiment are identified by the same reference numerals, and further description thereof is omitted. In the second embodiment of the invention there is only one connector 46.

A first position and a second position of the connector 46 in the second embodiment of the invention are described below with reference to FIG. 10 and FIG. 11. Whether the first position and the second position are locations that are biased to right-hand circularly polarized waves or are biased to left-hand circularly polarized waves is described below. Biased to right-hand circularly polarized waves means that radiation of right-hand circularly polarized waves is greater than radiation of left-hand circularly polarized waves, and biased to left-hand circularly polarized waves means that radiation of left-hand circularly polarized waves is greater than radiation of right-hand circularly polarized waves. Biased to right-hand circularly polarized waves is referred to below as simply right biased, and biased to left-hand circularly polarized waves is referred to below as simply left biased.

Figure 10:
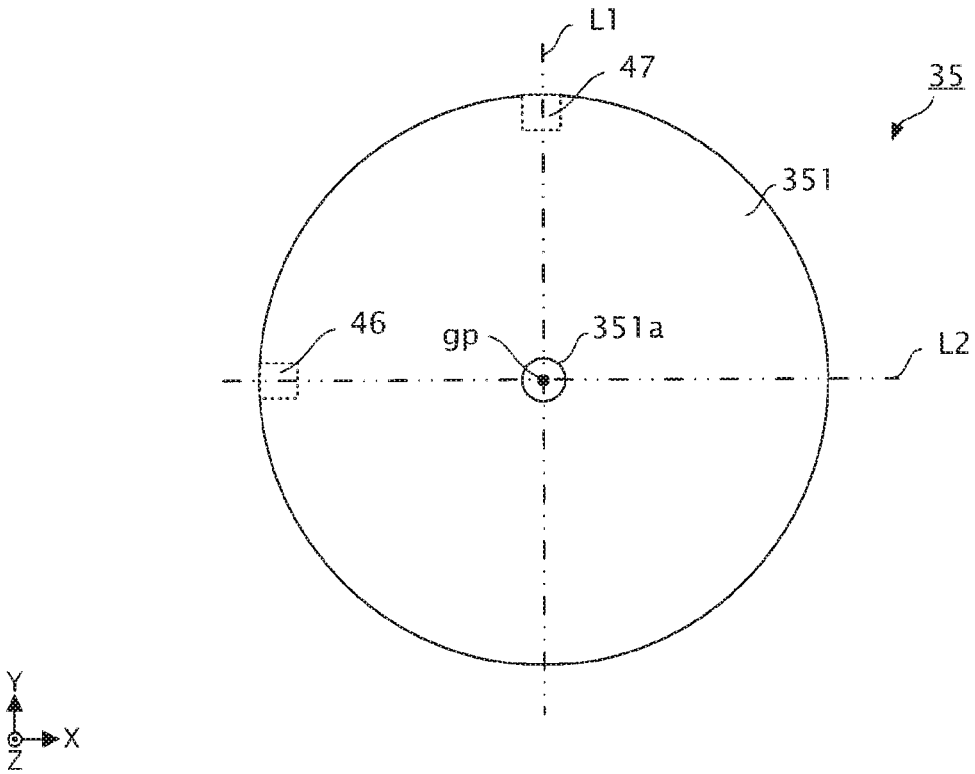
FIG. 10 shows an example of a connector 46 located in a first position in plan view.

FIG. 10 shows an example in plan view of the connector 46 located at a first position. As shown in FIG. 10 the connector 46 is at 9:00. In FIG. 10 the connector 46 is located in plan view at 9:00, and is disposed to the edge of the spacer 354. To describe the relative positions of the shorting member 353 and connector 46, in plan view the shorting member 353 is on an imaginary first line L1 through the center gp of the first electrode 351, and the connector 46 is on an imaginary line L2 through the center gp and perpendicular to the first line L1. Because the plane shape of the antenna 35 is round in plan view, the center gp is located inside the through-hole 351*a*. In plan view the shorting member 353, connector 46, and center gp do not overlap each other.

When the connector 46 is disposed to the first position, the radiation efficiency at a frequency of 1.417 GHz is 0.3734, antenna sensitivity is −4.27 dB, and radiation is right biased.

Figure 11:
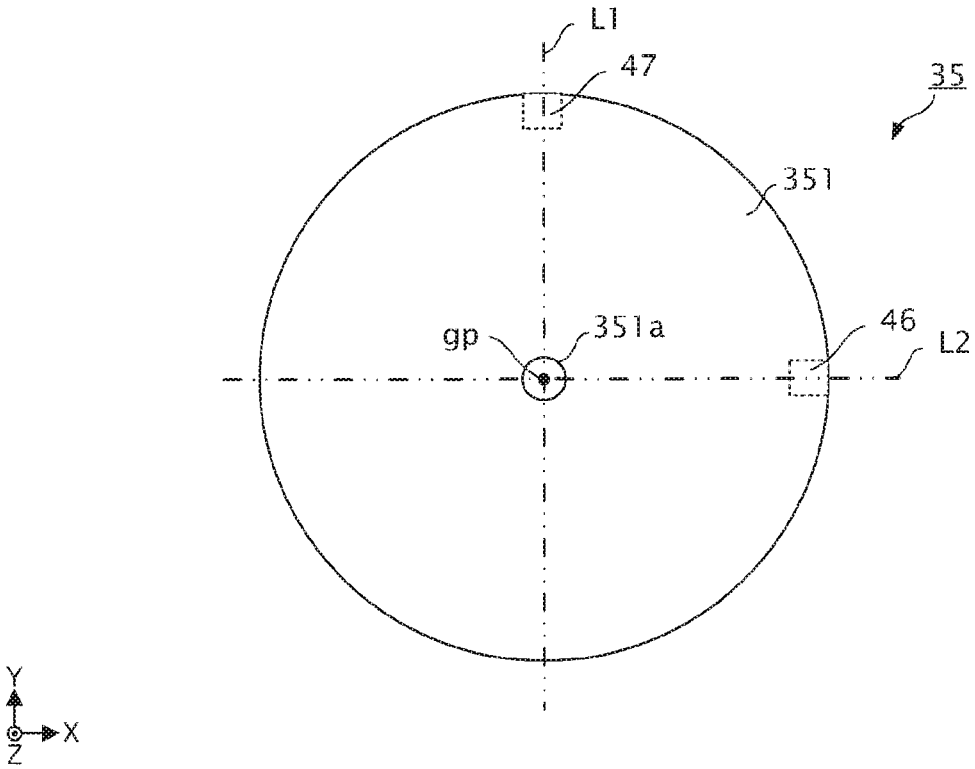
FIG. 11 shows an example of a connector 46 located in a second position in plan view.

FIG. 11 shows an example in plan view of the connector 46 located at a second position. As shown in FIG. 11 the connector 46 is at 3:00. In FIG. 11 the connector 46 is located in plan view at 3:00, and is disposed to the edge of the spacer 354. In plan view in FIG. 11 the connector 46 is disposed on a second line L2, and the shorting member 353, connector 46, and center gp do not overlap each other.

When the connector 46 is disposed to the second position, the radiation efficiency at a frequency of 1.417 GHz is 0.2742, antenna sensitivity is −4.26 dB, and radiation is left biased.

Note that when the connector 46 is at 12:00 in plan view, the radiation efficiency at a frequency of 1.417 GHz is 0.3267 and antenna sensitivity is −4.85 dB. When the connector 46 is at 6:00 in plan view, the radiation efficiency at a frequency of 1.417 GHz is 0.3472 and antenna sensitivity is −4.59 dB.

Effect of Embodiment 2

As described above, in an electronic timepiece W as an example of an electronic device according to the invention the shorting member 353 is on an imaginary first line L1 through the center gp of the first electrode 351, the connector 46 is on an imaginary line L2 through the center gp and perpendicular to the first line L1 in plan view, and in plan view the shorting member 353, connector 46, and center gp do not overlap. The location of the connector 46 at 9:00 is a first position, and location of the connector 46 at 3:00 is a second position.

This configuration is right biased when the location of the connector 46 is at the first position. Because GPS satellite signals are right-hand circularly polarized waves, the antenna 35 can more easily receive GPS satellite signals when the connector 46 is disposed to the first position. When the location of the connector 46 is at the second position, the configuration is left biased. As a result, the antenna 35 can more easily receive left-hand circularly polarized waves when the connector 46 is disposed to the second position.

Embodiment 3

Figure 12:
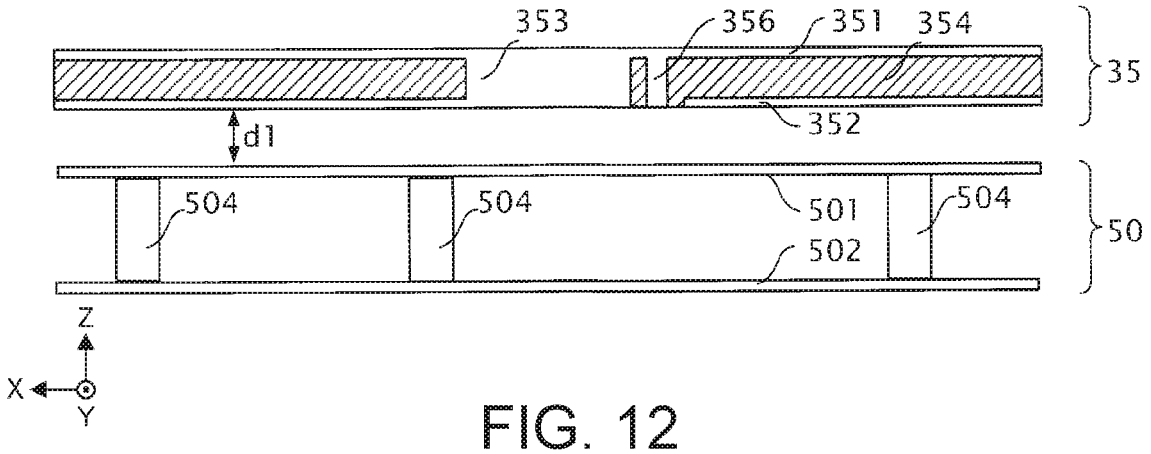
FIG. 12 shows an example of the electronic timepiece W.

In the third embodiment of the invention the second electrode 352 and the conductor 50 shown in FIG. 12 are separated and are not electrically connected by the connector 46. The third embodiment of the invention is described below.

FIG. 12 shows an example of a electronic timepiece W according to this embodiment. The antenna 35 and conductor 50 of the elements configuring the electronic timepiece W are shown in FIG. 12 for simplicity. The relative position of the conductor 50 is shown in side view with the second electrode 352 between the first electrode 351 and conductor 50. The conductor 50 operates as a parasitic antenna.

The conductor 50 includes a first conductive member 501, a second conductive member 502, and a connector 504. The first conductive member 501 is a planar conductive member disposed in plan view in a position superimposed with the first electrode 351. The second conductive member 502 is also a planar conductive member disposed in plan view in a position superimposed with the first electrode 351. In plan view, the plane shape of the first conductive member 501 and second conductive member 502 is round. Also in plan view, the antenna 35, first conductive member 501, and second conductive member 502 are superimposed with each other, and the superimposed area is preferably as large as possible. The first conductive member 501 and second conductive member 502 are disposed substantially parallel to the XY plane with a gap therebetween. The connector 504 electrically connects the first conductive member 501 and second conductive member 502. There are one or more connectors 504, and the electronic timepiece W shown in FIG. 12 has three connectors 504. The distance dl between the second electrode 352 and the first conductive member 501 is preferably less than or equal to 1/10 the wavelength of the resonance frequency of the antenna 35.

The first conductive member 501 is the conductive layer 451 of the circuit board 45, or a planar conductor of a specific thickness. This planar conductor is, for example, the circuit board holder 49 or a magnetic shield that protects the movement 40, for example, from external magnetic fields.

The second conductive member 502 is likewise the conductive layer 451 of the circuit board 45, or a planar conductor of a specific thickness.

For example, if the first conductive member 501 is the conductive layer 451 of the circuit board 45, the second conductive member 502 is the conductive layer of another circuit board or is a planar conductor. If the first conductive member 501 is the circuit board holder 49, the second conductive member 502 is the conductive layer 451 of the circuit board 45 or is a magnetic shield.

For example, the connector 504 may be a round or square column aligned with the Z-axis. One end of the connector 504 contacts the first conductive member 501, and the other end contacts the second conductive member 502. There are multiple connectors 504 disposed on the XY plane. In this example there are three connectors connector 504, and the three connectors 504 are disposed in this example at 3:00, 6:00, and 9:00 positions.

The reception circuit 453 may be disposed in the third embodiment of the invention in the following two configurations. In the first configuration the reception circuit 453 is on the side of the spacer 354 near the feed 356 of the antenna 35. In this configuration of the reception circuit 453 the maximum thickness of the reception circuit 453 is the thickness of the antenna 35.

In the second configuration the reception circuit 453 disposed on the first conductive member 501 when the first conductive member 501 is the conductive layer 451 of the circuit board 45. In this second configuration of the reception circuit 453, the reception circuit 453 and the antenna 35 are connected by a coaxial cable or other signal line. The antenna 35 and the first conductive member 501 are therefore connected by a signal line. However, because the conductor 50 is driven by an electric field radiating from the antenna 35, the combined operation of the antenna 35 and the conductor 50 is substantially unaffected by the effects of the antenna 35 and first conductive member 501 being connected by a conductive line.

Effect of Embodiment 3

As described above, the electronic timepiece W described as an example of an electronic device has an antenna 35 including a planar first electrode 351, a planar second electrode 352 disposed to a position superimposed with the first electrode 351 when seen in plan view in a direction perpendicular to the first electrode 351, and a shorting member 353 that shorts the first electrode 351 and second electrode 352; and a conductor 50 including a planar first conductive member 501 disposed in plan view to a position superimposed with the first electrode 351, a planar second conductive member 502 disposed in plan view to a position superimposed with the first electrode 351, and a connector 504 that electrically connects the first conductive member 501 and second conductive member 502. The second electrode 352 is disposed in a side view between the first electrode 351 and the conductor 50.

In this configuration, when it is difficult for the electric field radiating from the antenna 35 to penetrate between the second electrode 352 and first conductive member 501, conversion of the electric field to heat is suppressed, and radiation efficiency can be improved.

In the electronic timepiece W described as an example of an electronic device, the distance dl between the second electrode 352 and the first conductive member 501 is preferably less than or equal to 1/10 the wavelength of the resonance frequency of the antenna 35.

When the shortest distance dl is less than or equal to 1/10 the wavelength of the resonance frequency of the antenna 35 as in this configuration, it is difficult for the electric field radiating from the antenna 35 to enter between the second electrode 352 and first conductive member 501. By making it difficult for the electric field radiating from the antenna 35 to enter between the second electrode 352 and first conductive member 501, conversion of the electric field to heat is suppressed, and radiation efficiency can be improved.

Embodiment 4

A fourth embodiment of the invention is described next. Note that elements of this embodiment that have the same operation and function as in the first embodiment, second embodiment, or third embodiment are identified by the same reference numerals as in the first embodiment, second embodiment, or third embodiment, and further description thereof is omitted.

Figure 13:
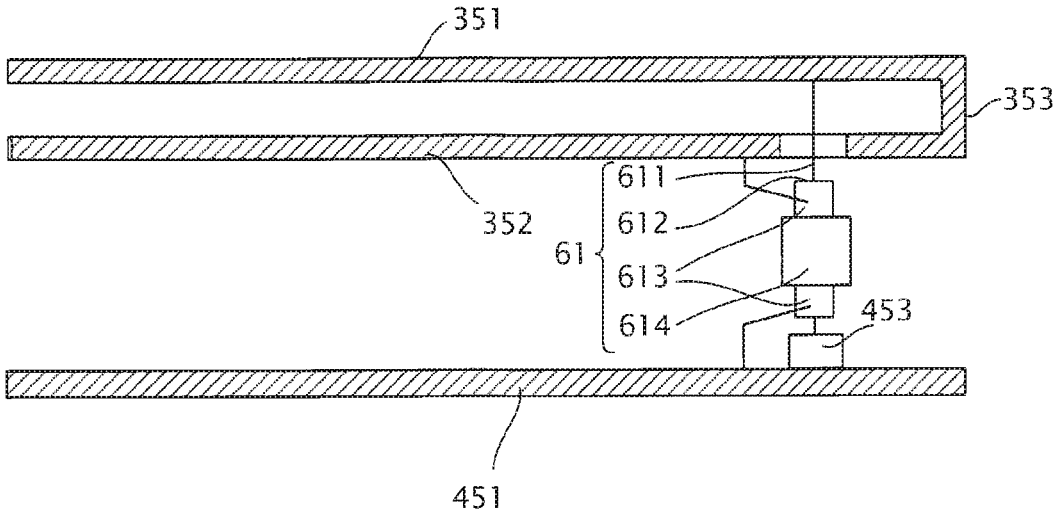
FIG. 13 illustrates the wiring connections in a fourth embodiment of the invention.

FIG. 13 shows the wiring arrangement in the fourth embodiment. As shown in FIG. 13, the electronic timepiece W has a coaxial cable 61. The coaxial cable 61 includes an internal conductor 611, a dielectric 612 surrounding the internal conductor 611, an external conductor 613 surrounding the dielectric 612, and a protective coating 614 surrounding the external conductor 613. The external conductor 613 surrounds the dielectric 612 and therefore also surrounds the internal conductor 611.

As shown in FIG. 13, the external conductor 613 electrically connects the conductive layer 451 and second electrode 352 instead of a connector 46. The internal conductor 611 electrically connects the reception circuit 453 of the circuit board 45 and the first electrode 351 instead of a signal line 47.

Effect of Embodiment 4

As described above, this electronic timepiece W described as an example of an electronic device has a circuit board 45 electrically connected to the antenna 35, and a coaxial cable 61 including an internal conductor 611 and an external conductor 613 surrounding the internal conductor 611. The planar conductor disposed opposite the first electrode 351 with the second electrode 352 therebetween is the conductive layer 451 formed on the circuit board 45; the connector 46 is the external conductor 613; and the circuit board 45 is electrically connected to the first electrode 351 by the internal conductor 611.

Because a single coaxial cable 61 is used instead of a connector 46 and signal line 47 in this configuration, GPS satellite signals can be efficiently passed to the circuit board 45 by a coaxial cable 61 appropriate for high frequency signals, the parts count of the wristwatch is reduced, and assembling the wristwatch is simplified.

Embodiment 5

A fifth embodiment of the invention is described next. Note that elements of this embodiment that have the same operation and function as in the first embodiment, second embodiment, third embodiment, or fourth embodiment are identified by the same reference numerals as in the first embodiment, second embodiment, third embodiment, or fourth embodiment, and further description thereof is omitted.

Figure 14:
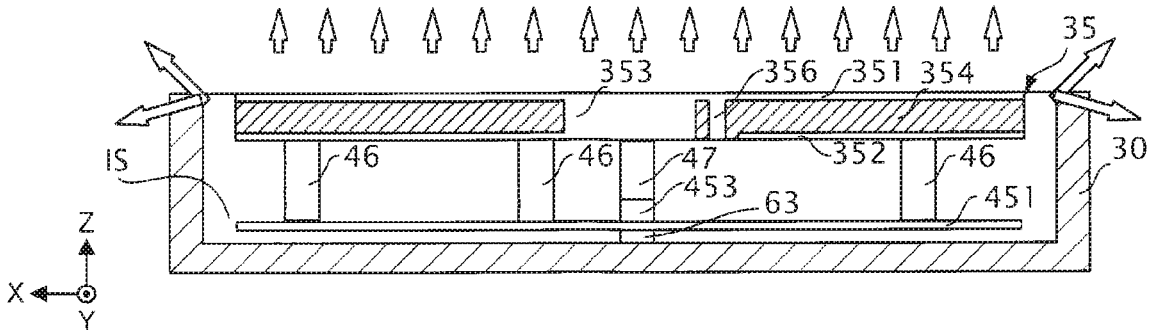
FIG. 14 shows an example of electric field production in a fifth embodiment of the invention.

FIG. 14 illustrates the electric field produced in this fifth embodiment. This wristwatch has a metal case connector 63. The metal case connector 63 electrically connects the metal case 30 and the conductive layer 451. Because of the metal case connector 63, the conductive layer 451 and the metal case 30 have the same potential, and an electric field is not radiated between the conductive layer 451 and metal case 30.

Effect of Embodiment 5

As described above, the electronic timepiece W described as an example of an electronic device has a metal case connector 63 that electrically connects the metal case 30 and the conductive layer 451. Because an electric field that radiates between the conductive layer 451 and metal case 30 in the first embodiment does not radiate in this configuration, conversion of an electric field to heat is suppressed and radiation efficiency can be improved.

Specific differences in the radiation efficiency of the first embodiment and this fifth embodiment are described below based on the radiation efficiency of the antenna 35 and antenna sensitivity at a frequency of 1.42 GHz.

The radiation efficiency of the first embodiment is 0.2382, and antenna sensitivity is −6.23 dB. In contrast, the radiation efficiency of the fifth embodiment is 0.322, and antenna sensitivity is −4.92 dB, and radiation efficiency is improved.

There may be one or multiple metal case connectors 63 in the fifth embodiment. Also in the fifth embodiment the conductive layer 451 and metal case 30 create a new parasitic antenna, and radiation efficiency varies.

Variation in directivity and radiation efficiency in relation to the number and locations of the metal case connector 63 are described below with reference to example 5-0, example 5-1, example 5-2, and example 5-3. Example 5-0 is an example of the first embodiment, and the number of metal case connectors 63 is 0.

In example 5-1 there is one metal case connector 63, which is located at a position superimposed in plan view with the signal line 47, that is, at the 12:00 position.

In example 5-2 there is one metal case connector 63, which in plan view is located point symmetrically to the signal line 47 from the pivot 38, that is, at the 6:00 position.

In example 5-3 there are two metal case connectors 63, a first metal case connector 63 is disposed to a position superimposed with the signal line 47 in plan view, and the second metal case connector 63 is disposed to a position point symmetrical to the signal line 47 from the pivot 38 in plan view.

The simulated results of the radiation efficiency of the antenna 35 and antenna sensitivity at a frequency of 1.3011 GHz in example 5-0, example 5-1, example 5-2, and example 5-3.

The radiation efficiency in example 5-0 is 0.09687, and antenna sensitivity is −10.13 dB. The radiation efficiency in example 5-1 is 0.1591, and antenna sensitivity is −7.98 dB. The radiation efficiency in example 5-2 is 0.1813, and antenna sensitivity is −7.41 dB. The radiation efficiency in example 5-3 is 0.1358.

Figure 15:
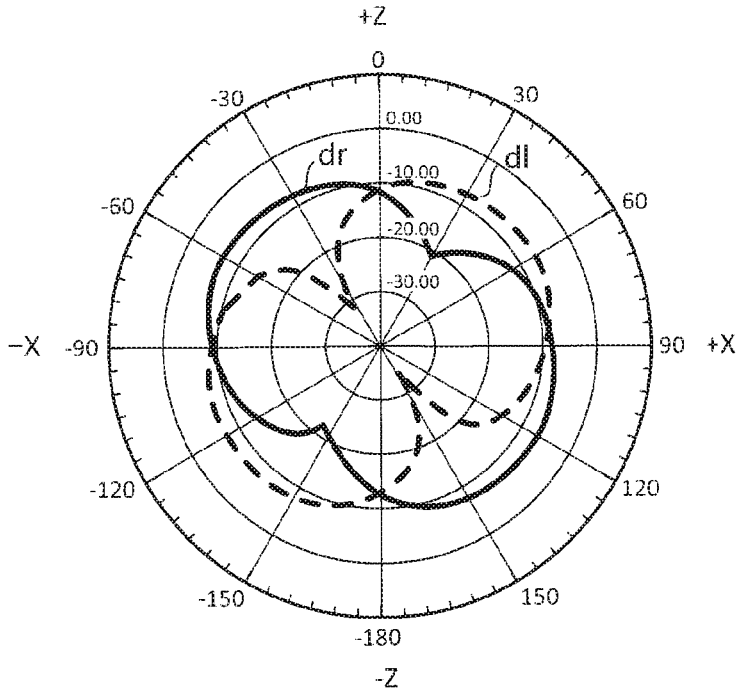
FIG. 15 illustrates directivity in embodiment 5-1.
Figure 16:
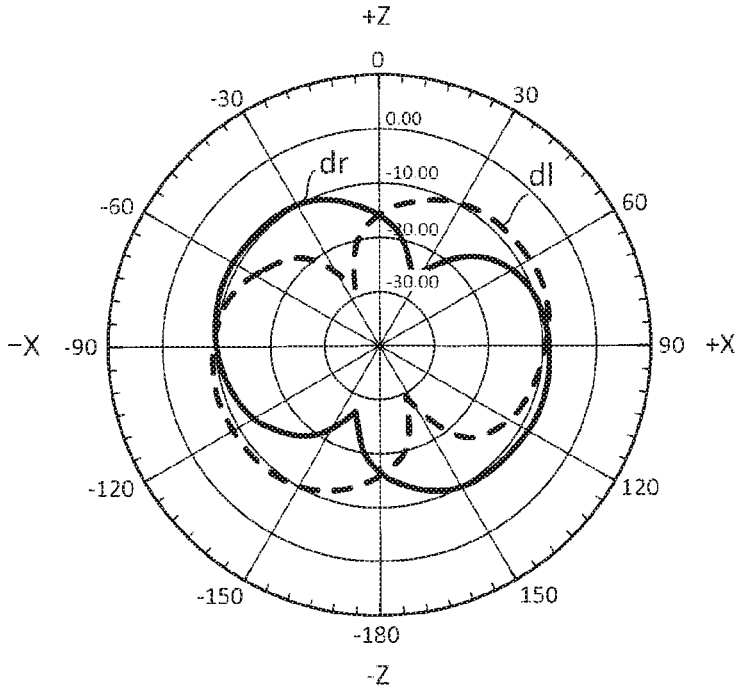
FIG. 16 illustrates directivity in embodiment 5-2.
Figure 17:
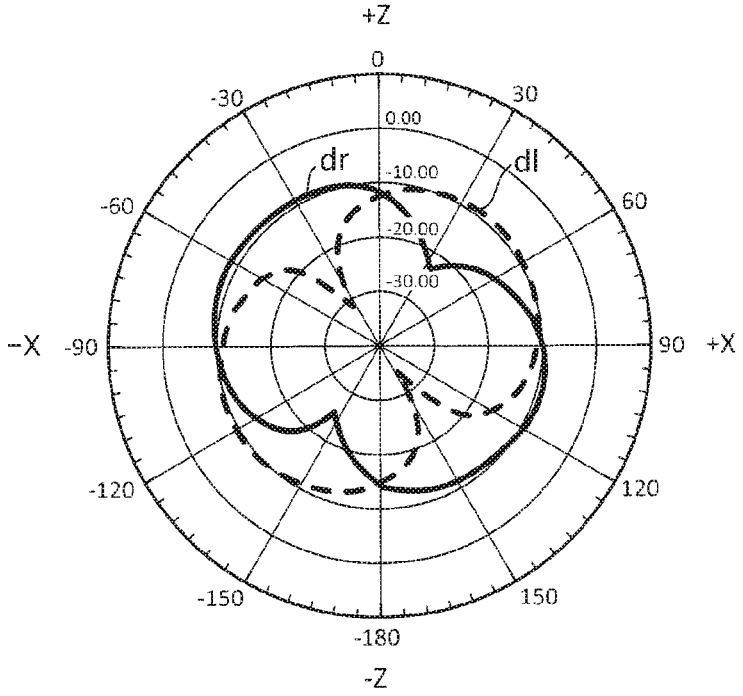
FIG. 17 illustrates directivity in embodiment 5-3.

FIG. 15, FIG. 16, and FIG. 17 illustrate the directivity in example 5-1, example 5-2, and example 5-3. In FIG. 15, FIG. 16, and FIG. 17, characteristic dr indicates directivity with right-hand circularly polarized waves, and characteristic dl indicates directivity with left-hand circularly polarized waves. In FIG. 15, FIG. 16, and FIG. 17, the positive Z-axis direction is at 0 degrees on the XZ plane, the positive X-axis direction is 90 degrees, the negative Z-axis direction is −180 degrees, and the negative X-axis direction is −90 degrees.

As shown in FIG. 15, the directivity of right-hand circularly polarized waves in example 5-1 is near −45 degrees on the XZ plane. As also shown in FIG. 15, the directivity of right-hand circularly polarized waves in example 5-2 is near −60 degrees on the XZ plane. The directivity of right-hand circularly polarized waves in example 5-3 is near −50 degrees on the XZ plane.

Considering that when the user looks at the dial 70 the dial 70 is roughly parallel to the ground, directivity is preferably not near the positive X-axis direction or the negative X-axis direction, and is preferably near the positive Z-axis direction.

Variations

The foregoing embodiments may be varied in many ways. Specific examples of some variations are described below. Two or more of the following variations may also be desirably combined insofar as they are not mutually contradictory. Note further that elements of the following embodiments and variations that have the same operation or function as in the embodiments described above are identified by the same reference numerals, and further description thereof is omitted.

In the first embodiment the first electrode 351 and second electrode 352 are conductive thin films formed by plating or vapor deposition the spacer 354, and the conductive layer 451 is a conductive thin film layer, but the invention is not so limited. For example, one or more of the first electrode 351, second electrode 352, and planar conductor disposed superimposed with the first electrode 351 in plan view may be a conductive sheet. The conductive sheet may be a metal plate, for example. One or more of the first electrode 351, second electrode 352, and conductor may also be a conductive thin film disposed to a non-conductive substrate.

For example, one or both of the first electrode 351 and second electrode 352 may be a planar conductor of a specific thickness. For example, if one or both of the first electrode 351 and second electrode 352 is a planar conductor of a specific thickness, the spacer 354 is disposed between the first electrode 351 and second electrode 352. If one of the first electrode 351 and second electrode 352 is a conductive thin film, the other is affixed to the spacer 354.

Also in the first embodiment the conductive layer 451 formed as a film on the planar substrate 450 is an example of a conductor, but the invention is not so limited. For example, the conductor may be a planar conductor of a specific thickness. The circuit board holder 49 and a magnetic shield are examples of elements that may also function as a planar conductor in an electronic timepiece. A planar conductor may also be provided solely for the purpose of creating a parasitic antenna instead of using another part disposed in a conventional electronic timepiece W as a planar conductor.

Likewise in the third embodiment, one or more of the first electrode 351, second electrode 352, first conductive member 501, and second conductive member 502 may be a planar conductor. In addition, one or more of the first electrode 351, second electrode 352, first conductive member 501, and second conductive member 502 may be a conductive thin film disposed to a non-conductive substrate. Yet further, either or both the first conductive member 501 and second conductive member 502 may be provided solely for the purpose of creating a parasitic antenna instead of using another part disposed in a conventional electronic timepiece W.

In the third embodiment the circuit element 452 is disposed to the feed 356 of the antenna 35 in a first configuration. This configuration may also be used in other embodiments. For example, in the first embodiment the reception circuit 453 may be disposed to the feed 356 of the antenna 35. In this case the signal line 47 may be omitted.

In the first embodiment, second embodiment, third embodiment, and fourth embodiment, the electronic timepiece W has a metal case 30, but a plastic case may be used instead of a metal case 30. The foregoing embodiments can also improve the sensitivity of the antenna 35 when using a plastic case.

The fifth embodiment describes the electronic timepiece W of the first embodiment having a metal case connector 63, but a metal case connector 63 may also be used in an electronic timepiece W according to the second embodiment, third embodiment, or fourth embodiment. For example, when the electronic timepiece W of the third embodiment has a metal case connector 63, the metal case connector 63 electrically connects the second conductive member 502 and metal case 30.

In the embodiments described above the shorting member 353 may short to the metal case connector 63. The resonance frequency of the antenna 35 does not vary whether or not the shorting member 353 shorts to the metal case connector 63.

The antenna 35 in the foregoing examples receives GPS satellite signals, but may be configured to receive satellite signals from Global Navigation Satellite System (GNSS) satellites and navigation satellites other than GNSS. For example, the antenna 35 may be configured to receive satellite signals from one or two or more satellite systems, including WAAS (Wide Area Augmentation System), EGNOS (European Geostationary-Satellite Navigation Overlay Service), QZSS (Quasi Zenith Satellite System), GLONASS (GLObal NAvigation Satellite System), GALILEO, or BeiDou (BeiDou Navigation Satellite System).

The embodiments described above the antenna 35 may also be applied to antennae for sending and receiving radio signals other than GPS satellite signals. Examples of such radio signals include Bluetooth and Wi-fi. Bluetooth and Wi-fi are registered trademarks.

The foregoing embodiments are applied to an electronic timepiece W, but the electronic device to which these embodiments are applied is not limited to an electronic timepiece, and may be applied to electronic devices having an antenna 35 at a circuit board 45 or planar conductor.

Examples of electronic devices having an antenna 35 and a circuit board 45 include, for example, USB transceivers that connect wirelessly to devices such as mice and keyboards, and connect by a USB (Universal Serial Bus) connection to a PC (Personal Computer), and beacons that transmit a unique ID (IDentifier) and results measured by a sensor according to the LPWA (Low-Power Wide-Area Network) protocol.

The embodiments described above may also be applied to electronic devices having a display configured by an LCD panel, electronic paper panel, or an organic electroluminescence panel, an antenna 35, and a circuit board 45. Examples of electronic devices having a display, antenna, and circuit board 45 include cell phones, smartphones, tablet terminals, and game machines.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. An electronic timepiece comprising:

an antenna having a planar first electrode, a planar second electrode disposed to a position superimposed with the first electrode in a plan view when seen from a first direction perpendicular to the first electrode, and a shorting member that shorts the first electrode and second electrode;

a reception circuit that processes signals received through the antenna;

a feed that electrically connects the planar first electrode and the reception circuit, the feed being separate from the second electrode;

a planar conductor disposed in the plan view to a position superimposed with the first electrode; and a connector that electrically connects the second electrode and the planar conductor, wherein the second electrode disposed between the first electrode and the planar conductor in a side view from a second direction perpendicular to the first direction.

2. The electronic timepiece described in claim 1, wherein:

the shorting member is disposed in the plan view on an imaginary first line through a center of the first electrode, the connector is disposed in the plan view on an imaginary second line through the center and perpendicular to the first line, and in the plan view that the shorting member, the connector, and the center are not mutually superimposed.

3. The electronic timepiece described in claim 1, further comprising:

a circuit board electrically connected to the antenna; and a coaxial cable having an internal conductor and an external conductor surrounding the internal conductor in the plan view;

the conductor being a conductive thin film disposed to the circuit board;

the connector being the external conductor; and the circuit board being electrically connected to the first electrode by the internal conductor.

4. The electronic timepiece described in claim 1, wherein:

one or more of the first electrode, second electrode, and conductor is a planar conductor.

5. The electronic timepiece described in claim 1, wherein:

one or more of the first electrode, second electrode, and conductor is a conductive thin film disposed to a non-conductive substrate.

6. The electronic timepiece described in claim 1, wherein:

there are multiple connectors.

7. The electronic timepiece described in claim 1, wherein:

the electronic timepiece has a metal case in which the antenna is disposed.

8. An electronic timepiece comprising:

an antenna having a planar first electrode, a second electrode disposed to a position superimposed with the first electrode in a plan view when seen from a first direction perpendicular to the first electrode, and a shorting member that shorts the first electrode and second electrode; and a conductor including a planar first conductive member disposed in the plan view to a position superimposed with the first electrode, a planar second conductive member disposed in the plan view to a position superimposed with the first electrode, and a connector that electrically connects the first conductive member and second conductive member, wherein the second electrode disposed between the first electrode and the conductor in a side view from a direction perpendicular to the first direction.

9. The electronic timepiece described in claim 8, wherein:

a shortest distance between the second electrode and the first conductive member is less than or equal to 1/10 the wavelength of a resonance frequency of the antenna.

10. The electronic timepiece described in claim 8, wherein:

one or more of the first electrode, second electrode, first conductive member, and second conductive member is a planar conductor.

11. The electronic timepiece described in claim 8, wherein:

one or more of the first electrode, second electrode, first conductive member, and second conductive member is a conductive thin film disposed to a non-conductive substrate.

12. The electronic timepiece described in claim 7, further comprising:

a metal case connector that electrically connects the metal case and the conductor.

* * * * *